US006821639B2

(12) United States Patent
Kato

(10) Patent No.: US 6,821,639 B2
(45) Date of Patent: Nov. 23, 2004

(54) METAL SUBSTRATE FOR CARRYING CATALYST AND METHOD FOR MANUFACTURING THE SAME

(75) Inventor: Fumihiko Kato, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 141 days.

(21) Appl. No.: 10/338,641

(22) Filed: Jan. 9, 2003

(65) Prior Publication Data

US 2003/0152795 A1 Aug. 14, 2003

(30) Foreign Application Priority Data

Jan. 10, 2002 (JP) ..... 2002-003034

(51) Int. Cl.[7] ..... B32B 3/12; F01N 3/28; B01J 35/04; B23K 101/02

(52) U.S. Cl. ..... 428/593; 428/594; 502/527.22; 422/180; 228/181; 29/890

(58) Field of Search ..... 428/593, 594; 422/180; 502/527.22, 439; 228/181; 29/890

(56) References Cited

U.S. PATENT DOCUMENTS

| | | | | | |
|---|---|---|---|---|---|
| 4,713,361 | A | | 12/1987 | Maus | |
| 4,795,615 | A | * | 1/1989 | Cyron et al. | 422/179 |
| 4,948,353 | A | * | 8/1990 | Maus et al. | 422/180 |
| 5,094,072 | A | * | 3/1992 | Ampferer et al. | 60/290 |
| 5,104,627 | A | * | 4/1992 | Usui et al. | 422/171 |
| 5,113,653 | A | * | 5/1992 | Usui et al. | 60/299 |
| 5,190,732 | A | * | 3/1993 | Maus et al. | 422/179 |
| 5,272,875 | A | | 12/1993 | Kaji | |
| 5,278,125 | A | * | 1/1994 | Iida et al. | 502/439 |
| 5,346,675 | A | * | 9/1994 | Usui et al. | 422/180 |
| 5,729,902 | A | * | 3/1998 | Wieres et al. | 29/890 |
| 6,334,981 | B1 | | 1/2002 | Wieres | |
| 6,368,726 | B1 | * | 4/2002 | Holpp et al. | 428/593 |

FOREIGN PATENT DOCUMENTS

| | | | |
|---|---|---|---|
| DE | 89 00 168.0 | U | 3/1989 |
| DE | 4303950 | * | 10/1994 |
| DE | 196 27 289 | A1 | 12/1997 |
| JP | 6-272548 | A | 9/1994 |
| JP | 6-277527 | A | 10/1994 |
| JP | 7-4824 | U | 1/1995 |
| JP | 08-266905 | * | 10/1996 |

OTHER PUBLICATIONS

Patent Abstracts of Japan, vol. 015, No. 038, Jan. 30, 1991, JP 2–273548, Nov. 8, 1990.

Patent Abstracts of Japan, vol. 1997, No. 02, Feb. 28, 1997, JP 8–266905, Oct. 15, 1996.

* cited by examiner

*Primary Examiner*—John J. Zimmerman
(74) *Attorney, Agent, or Firm*—Foley & Lardner LLP

(57) ABSTRACT

A wide sheet formed of a metal foil is wound a plurality of times around outer peripheral surfaces of four honeycomb matrices arranged in series to form an intermediate tube. As a result, a subassembly is formed. A brazing filler material is wound around an outer peripheral surface of the subassembly at an end portion thereof. The subassembly is inserted into an outer tube. The outer tube is caulked to reduce an outer diameter thereof. Then, heat processing is performed in vacuum to diffusion bond a corrugated sheet and a flat sheet, which form the honeycomb matrices, and the wide sheet of the intermediate tube to each other. The intermediate tube and the outer tube are brazed to each other. Thus, a metal substrate for carrying a catalyst is achieved.

11 Claims, 5 Drawing Sheets

METAL SUBSTRATE FOR CARRYING CATALYST AND METHOD FOR MANUFACTURING THE SAME

The present disclosure relates to the subject matter contained in Japanese Patent Application No. 2002-3034 filed on Jan. 10, 2002, which is incorporated herein by reference in its entirety.

BACKGROUND OF THE INVENTION

1. Field of the Invention

The present invention relates to a metal substrate for carrying a catalyst installed in an exhaust system of a vehicle for purifying exhaust gas and a method for manufacturing the same.

2. Description of the Related Art

A substrate for carrying a catalyst is known, which is constructed such that a plurality of honeycomb matrices formed by rolling metallic foil are arranged in series inside a single casing.

According to this technique, in comparison with a substrate for carrying a catalyst whose whole body is formed by a single honeycomb matrix, the divided individual honeycomb matrices is compact, and the heat capacity decreases. Hence, there is an advantage in that the temperature increases at an early period with starting from a honeycomb matrix disposed on an exhaust gas inlet side at a time of the cold starting of the engine, and activation of the catalyst starts.

Such a metal substrate for carrying a catalyst in which the plurality of honeycomb matrices are arranged in series is fabricated by a method in which the individually fabricated honeycomb matrices are brazed to inner surfaces of short outer tubes to form unit substrates, and the outer tubes of the unit substrates are butt welded into a monolith, or a method in which after individual honeycomb matrices respectively having a brazing filler material wound therearound are inserted into one outer tube at predetermined intervals, the honeycomb matrices are brazed to the inner surface of the outer tube upon heating.

However, with regard to the metal substrate based on the former fabrication method, welding must be performed with respect to each unit substrate, so that the fabrication involves time. Also with regard to the metal substrate based on the latter fabrication method, it is difficult to insert the plurality of honeycomb matrices with the brazing filler material wound therearound into the outer tube by maintaining the predetermined intervals.

Furthermore, thermal stress occurs in the honeycomb matrix due to a temperature difference between upstream and downstream of a flow of exhaust gas. Therefore, to avoid a decline in durability due to this difference, when the honeycomb matrix is brazed to the outer tube, it is necessary to limit a brazing portion to a downstream side and release an exhaust gas inlet side from constraint to allow thermal expansion. However, there are problems in that since the length of the honeycomb matrix is short, the brazing filler material is liable to flow, and it is difficult to control the brazing range in any honeycomb matrix, and that since distance from the brazing portion to a free end is short in all honeycomb matrices, the alleviation of stress cannot be substantially expected in all honeycomb matrices.

SUMMARY OF THE INVENTION

Accordingly, in view of the above-described problems, the object of the invention is to provide a metal substrate for carrying a catalyst, which can be fabricated easily and in which the alleviation of thermal stress can be realized at low cost, as well as a method of manufacturing the same.

To this end, according to a first aspect of the invention, there is provided a metal substrate for carrying a catalyst including an outer tube, a plurality of honeycomb matrices arranged in series in the outer tube, and an intermediate tube, which is formed by winding a wide sheet made of a metal foil around an outer peripheral surface of the plurality of honeycomb matrices. The intermediate tube is bonded to the plurality of honeycomb matrices. The intermediate tube is brazed in a predetermined region on an outer peripheral surface at an end portion thereof and are bonded to the outer tube.

Despite the fact that a plurality of honeycomb matrices are provided, brazing is affected at one portion, so that the cost can be lowered, and the thermal stress can be reduced reliably.

According to a third aspect of the invention, there is provided a method for manufacturing a metal substrate for carrying a catalyst, the metal substrate having a plurality of honeycomb matrices arranged in series in an outer tube, the method including the steps of winding a wide sheet formed of a metal foil around outer peripheral surfaces of the plurality of honeycomb matrices to form a subassembly in which the plurality of honeycomb matrices are arranged in an intermediate tube formed of the wide sheet, winding a brazing filler material around an outer peripheral surface of the intermediate tube at an end portion of the intermediate tube, inserting the subassembly into an outer tube, and heat processing the outer tube into which the subassembly is inserted.

According to a fourth aspect of the invention, in the third aspect, the heat processing step bonds the plurality of honeycomb matrices to the intermediate tube and brazes the intermediate tube to the outer tube.

Since the plurality of honeycomb matrices are inserted into the outer tube as one subassembly and brazing is affected, the operation is extremely simple.

According to a fifth aspect of the invention, the method of any one of the third and fourth aspects further includes the steps of lapping and winding each corrugated sheet and each flat sheet around a common core bar to form the plurality of honeycomb matrices concurrently, winding the wide sheet around the plurality of honeycomb matrices to form the intermediate tube, and pulling out the common core bar from the honeycomb matrices to form the subassembly.

Sine the plurality of honeycomb matrices are simultaneously fabricated on a common core bar, the honeycomb matrices can be efficiently formed into the same size, and the formation of the intermediate tube can be subsequently affected simply.

According to a sixth aspect of the invention, the method of any one of the third to fifth aspects, further includes the steps of reducing an outer diameter of the outer tube into which the subassembly is inserted, before the heat processing step.

By virtue of the diameter reduction, the degree of contact between adjacent ones of the honeycomb matrices, the intermediate tube, and the outer tube can be promoted, thereby making it possible to ensure more satisfactory bonding or brazing.

According to second and seventh aspects of the invention, the wide sheet is formed into a lap-wound layered form in which a flat sheet and a corrugated sheet are lapped and wound. Consequently, an increase in the strength of the wide sheet can be attained.

DETAILED DESCRIPTION OF THE PREFERRED EMBODIMENTS

Hereafter, a description will be given of an embodiment of the invention.

Figure 1:
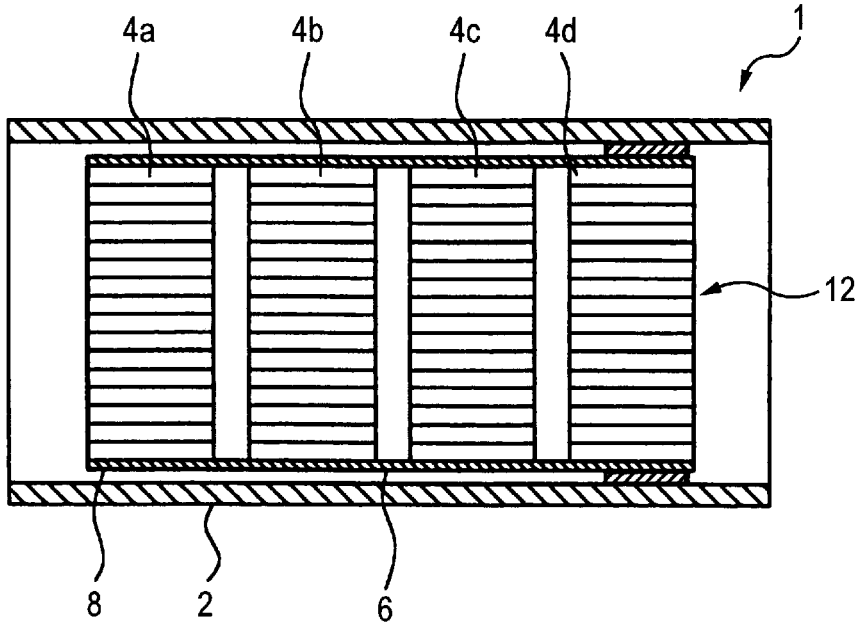
FIG. 1 is a vertical cross-sectional view illustrating a metal substrate in accordance with an embodiment of the invention.

FIG. 1 is a vertical cross-sectional view illustrating the embodiment. A metal substrate 1 for carrying a catalyst has four honeycomb matrices 4 (4*a*, 4*b*, 4*c*, and 4*d*) in an outer tube 2. The respective honeycomb matrices 4 are formed into the same size having the same diameter by lapping and winding a corrugated sheet and a flat sheet which are respectively formed of metallic foil. Further, a wide sheet 6 of a metallic foil having a breadth for covering all the honeycomb matrices is wound a plurality of times (e.g., three times) around outer peripheries of the four honeycomb matrices 4*a*, 4*b*, 4*c*, and 4*d* arranged in a row with predetermined intervals provided therebetween, thereby forming an intermediate tube 8.

As the wide sheet 6, it is preferable to use metallic foil made of the same material and having the same thickness as those of the corrugated sheet and the flat sheet for forming the honeycomb matrices 4.

Adjacent layers of the corrugated sheet and flat sheet in each honeycomb matrix 4, adjacent layers in the wide sheet 6, and each of honeycomb matrices 4 and the wide sheet 6 are joined by diffusion bonding, respectively.

In addition, the intermediate tube 8 formed of the wide sheet 6, inside which the four honeycomb matrices 4*a*, 4*b*, 4*c*, and 4*d* are wound, is accommodated in the outer tube 2 in a state of contact with the inner wall of the outer tube 2, and is joined to the outer tube 2 by brazing in a predetermined region in the vicinity of a downstream end of the flow of exhaust gas.

It should be noted that, in FIG. 1, the intermediate tube 8 and the inner wall o the outer tube 2 are shown as being spaced apart to facilitate an understanding.

The metal substrate 1 constructed as described above is fabricated in the following procedure.

Figure 2:
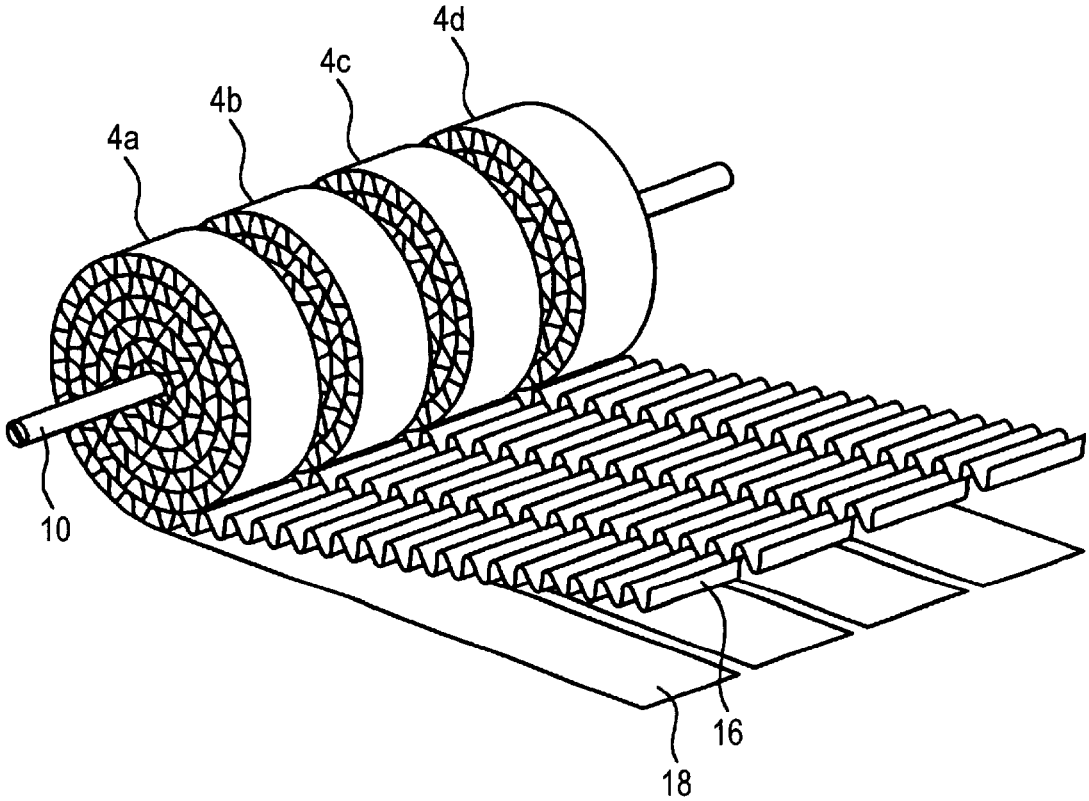
FIG. 2 is an explanatory diagram illustrating the process of fabrication of the metal substrate.

(1) First, as shown in FIG. 2, four sets of a corrugated sheet 16 and a flat sheet 18 for making up the honeycomb matrices 4*a*, 4*b*, 4*c*, and 4*d* are set on a common core bar 10 at predetermined intervals and are lapped and wound therearound.

Figure 3:
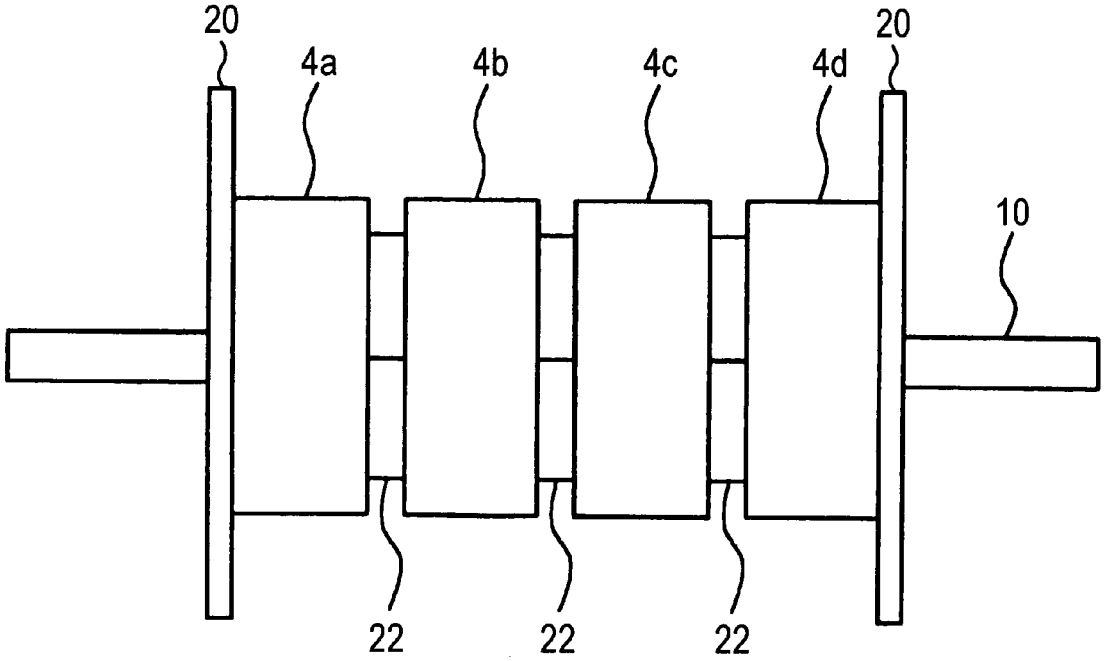
FIG. 3 is an explanatory diagram illustrating the process of fabrication of the metal substrate.

At this time, as shown in FIG. 3 which is a top view, outer sides of the honeycomb matrices 4*a* and 4*d* at both ends are restricted by a pair of discs 20 adapted to rotate together with the core bar 10. Two-piece type spacers 22 are mounted on the core bar 10 between adjacent ones of the honeycomb matrices 4*a*, 4*b*, 4*c*, and 4*d* to restrict the intervals between adjacent ones of the honeycomb matrices.

Figure 4:
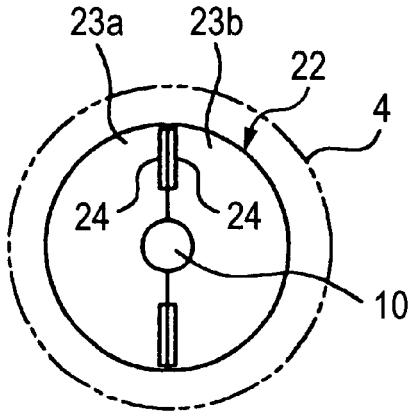
FIG. 4 is a front elevational view illustrating a spacer.

As shown in FIG. 4, the spacer 22 includes two halves 23 (23*a* and 23*b*), which are split along a line passing through the core bar 10. Each half 23 has a semicircular shape. A pair of magnets 24*s* is provided on the split surfaces. A hole through which the core bar 10 passes when the magnets 24 are attracted to each other to join the split surfaces is formed in the center of the spacer 22. The orientations of the split surfaces of the three spacers 22 are made to match each other in advance.

(2) After the corrugated sheet 16 and the flat sheet 18 are lapped and wound up to a predetermined size and the four honeycomb matrices 4*a*, 4*b*, 4*c*, and 4*d* are formed concurrently, the winding ends of the respective honeycomb matrices 4 are tentatively fixed by spot welding.

Figure 5:
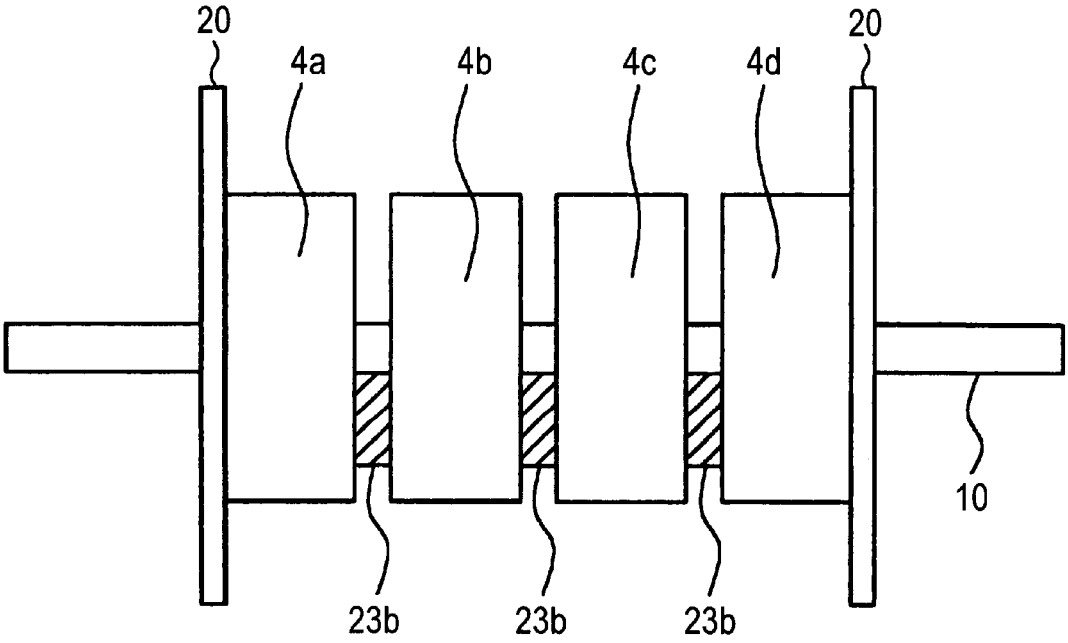
FIG. 5 is an explanatory diagram illustrating the process of fabrication of the metal substrate, and illustrating a state in which one-side halves of the spacers have been removed.

(3) Next, as shown in FIG. 5, the one-side halves 23*a* on the same side of the spacers are removed to leave only the halves 23*b*. It is presumed that, at this time, the halves 23*b* will not drop due to contact with the wound honeycomb matrices. However, it is preferable to dispose a magnet also at a portion of each half which comes into contact with the core bar 10, so as to ensure that the halves will not drop.

Figure 6:
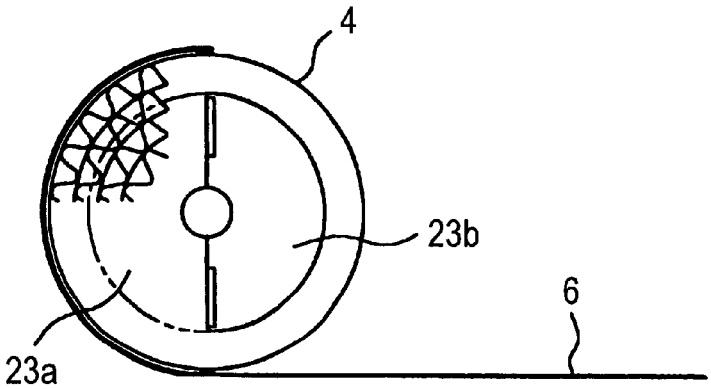
FIG. 6 is an explanatory view taken from an axial direction, illustrating the process of fabrication of the metal substrate.
Figure 7:
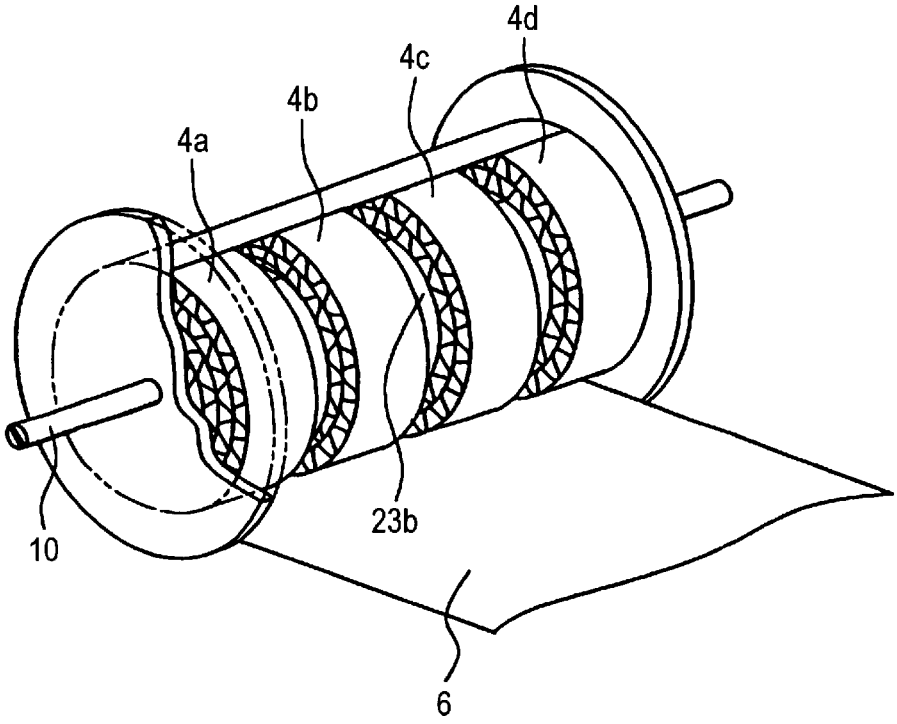
FIG. 7 is an explanatory diagram illustrating the process of fabrication of the metal substrate.

Further, as shown in FIG. 6, the wide sheet 6 made of the same material as that of the flat sheet is wound by a half turn around the outer peripheries of the four honeycomb matrices 4 (4*a*, 4*b*, 4*c*, and 4*d*) in correspondence with the region where the halves 23*a* have been removed. The wide sheet 6 is fixed to the honeycomb matrices 4*a*, 4*b*, 4*c*, and 4*d* by spot welding. FIG. 7 is a perspective view illustrating this state.

Figure 8:
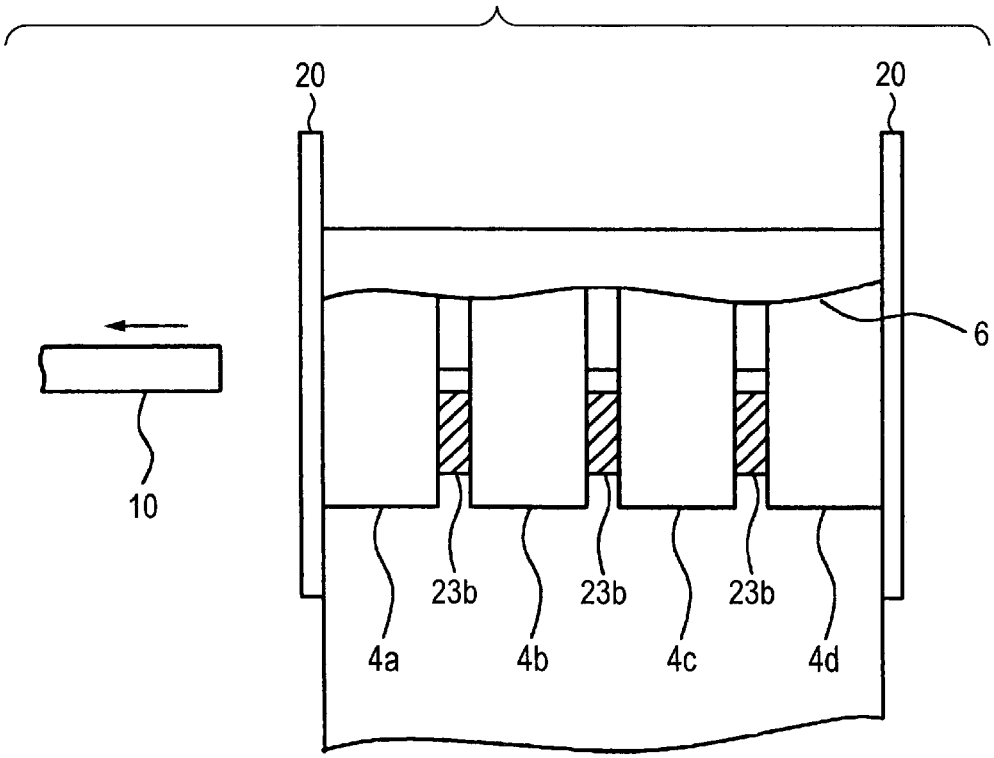
FIG. 8 is an explanatory diagram illustrating the process of fabrication of the metal substrate, and illustrating a state in which a core bar has been removed.

(4) Then, as shown in FIG. 8, the core bar 10 is pulled out from the four honeycomb matrices 4*a*, 4*b*, 4*c*, and 4*d*. At this time, when the core bar 10 is pulled out toward, for instance, the honeycomb matrix 4*a* side, the honeycomb matrix 4*a* has its end face supported by the disc 20, and the other honeycomb matrices 4*b*, 4*c*, and 4*d* have their end faces supported by the halves 23*b* of the spacers remaining at the intervals between the honeycomb matrices. Hence, each of these honeycomb matrices is prevented from losing shape.

Figure 9:
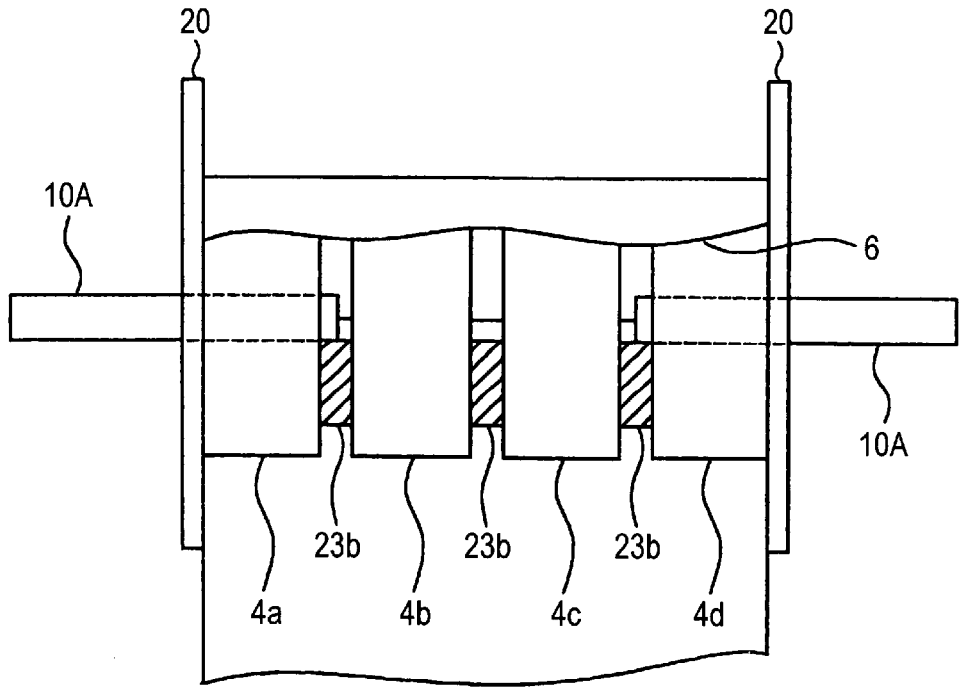
FIG. 9 is an explanatory diagram illustrating the process of fabrication of the metal substrate, and illustrating a state in which short core bars have been inserted.

(5) Subsequently, as shown in FIG. 9, two short core bars 10*A* are respectively inserted in the honeycomb matrices 4*a* and 4*d* at both ends. The short core bars 10A, 10A are set so as not to reach the respectively adjacent honeycomb matrices 4*b* and 4*c*. In this case as well, since the halves 23*b* of the spacers 22 support the inner end faces of the honeycomb matrices 4*a* and 4*d*, the honeycomb matrices 4*a* and 4*d* are prevented from losing shape at the time of the insertion of the short core bars 10A.

(6) Subsequently, after all the remaining halves 23*b* of the spacers 22 are removed, the wide sheet 6 is further wound a plurality of times with the short core bars 10A, 10A at both ends serving as the center of rotation, the winding end of the wide sheet are tentatively fixed by spot welding. Here, the core bars 10A are respectively pulled out from the honeycomb matrices 4*a* and 4*d* by using the discs 20 as supports for the end faces.

Figure 10:
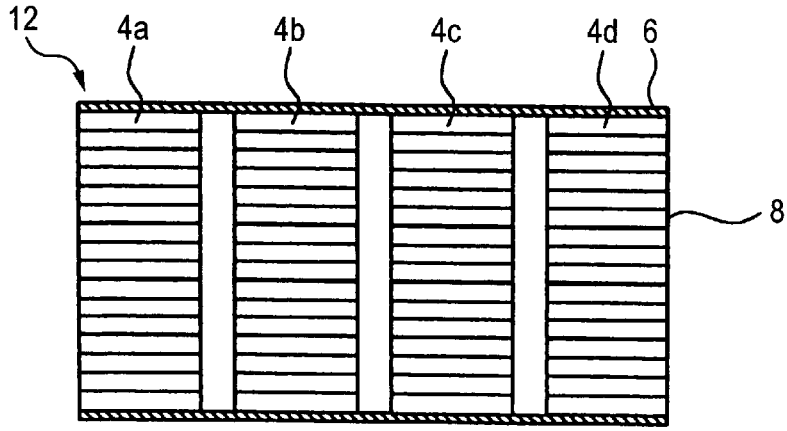
FIG. 10 is a cross-sectional view illustrating a subassembly.

Consequently, as shown in FIG. 10, a subassembly 12 is formed which has the four honeycomb matrices 4*a*, 4*b*, 4*c*, and 4*d* inside the intermediate tube 8 formed of the wide sheet 6.

Figure 11:
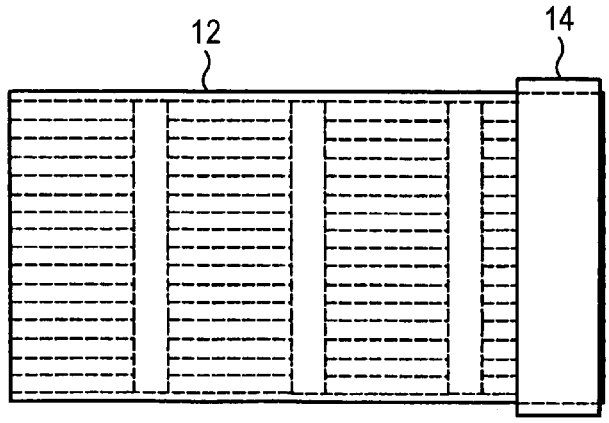
FIG. 11 is an explanatory diagram illustrating the process of fabrication of the metal substrate, and illustrating a state a brazing filler material is wound around the subassembly 12.

(7) Next, as shown in FIG. 11, a brazing filler material 14 having a predetermined width is wound around an outer periphery of this subassembly 12 on a side corresponding to the downstream end of the flow of exhaust gas.

(8) Next, after the subassembly 12 with the aforementioned brazing filler material wound therearound is inserted in the outer tube 2 having a closed section, the outer tube 2 is subjected to diameter reduction. Then, the set of this outer tube 2 and the subassembly 12 is subjected to heat treatment in a vacuum.

As a result, the corrugated sheet, the flat sheet, and the wide sheet 6 in the subassembly 12 are diffusion bonded to each other. The wide sheet 6 (intermediate tube 8) of the subassembly 12 and the outer tube 2 are brazed to each other. The metal substrate 1 is achieved such as the one shown in FIG. 1 referred to above.

The metal substrate for carrying a catalyst in accordance with this embodiment is constructed as described above. The plurality of honeycomb matrices 4*a*, 4*b*, 4*c*, and 4*d* arranged in a row are wound by the wide sheet 6 made of the same metallic foil as that constituting the honeycomb matrices so as to form the one-unit subassembly 12. This subassembly 12 is inserted in the outer tube 2. Therefore, brazing can be affected only at one limited predetermined portion, which lowers the cost. In addition, since the intermediate tube 8 to which the plurality of honeycomb matrices 4*a*, 4*b*, 4*c*, and 4*d* are joined is formed of the same foil as that of the corrugated sheet and the flat sheet, which make up the honeycomb matrices, the thermal stress in each honeycomb matrix can be reduced reliably.

Similarly, since one subassembly 12 is merely joined to one outer tube 2, it is unnecessary to connect short outer tubes by welding, or no trouble is involved in holding the intervals between adjacent ones of the honeycomb matrices.

It should be noted that although in the embodiment a description has been given of the case where the number of honeycomb matrices 4 is four, the invention is not limited to the same. The invention is applicable to metal substrate for carrying a catalyst in which an arbitrary number of honeycomb matrices are arranged in the outer tube.

In addition, although it has been described that each honeycomb matrix 4 is formed by using the flat sheet and the corrugated sheet and lapping and winding them, the invention is not limited to the same. Each honeycomb matrix 4 may be formed by lapping and winding a relatively short pitch corrugated sheet and a relatively long pitch corrugated sheet. Accordingly, in the invention, the flat sheet may include a short pitch corrugated sheet whose ridge height is smaller than that of a corrugated sheet.

As the wide sheet 6, it is possible to use one or more flat sheet or one or more flat sheet of a single type, which are superposed on another. In addition, the wide sheet 6 may be formed into a lap-wound layered form in which such a flat sheet and a corrugated sheet are lapped and wound in five layers or less (or with a layer thickness of about 10 mm), so as to be subjected to diffusion bonding together with the honeycomb matrices. This improves the strength of the wide sheet, eliminates the possibility of deformation or the like at the time of inserting the subassembly into the outer tube, and facilitates the insertion.

Further, with regard to the assembly of the outer tube 2 and the subassembly 12 prior to heat treatment, the subassembly 12 is inserted in the outer tube 2 having a closed section and the outer tube 2 is subjected to diameter reduction, as described above. Alternatively, however, after the subassembly 12 is inserted in the outer tube having a C-shaped section, the outer tube may be caulked, and its side edges may be welded together.

As described above, in the metal substrate in accordance with the invention, the plurality of honeycomb matrices are joined to an intermediate tube formed by winding a wide sheet of metallic foil around outer peripheries thereof, and that the intermediate tube is joined to the outer tube by brazing at a predetermined region of an outer peripheral surface of an end portion thereof. Therefore, the plurality of honeycomb matrices are joined to the outer tube by brazing at one portion, so that there are advantages that the cost is lowered, and that the thermal stress is reduced reliably.

In the manufacturing method in accordance with the invention, a subassembly in which the plurality of honeycomb matrices are disposed in an intermediate tube of metallic foil formed of a wide sheet is formed by winding the wide sheet around outer peripheries of the plurality of honeycomb matrices arranged in series; a brazing filler material is wound around an outer peripheral surface of an end portion of the intermediate tube and the subassembly is inserted into the outer tube; and the outer tube with the subassembly inserted therein is subjected to heat treatment, thereby joining together the plurality of honeycomb matrices and the intermediate tube and brazing together the intermediate tube and the outer tube. Therefore, the plurality of honeycomb matrices are inserted into the outer tube as one unit, and brazing is affected, so that the operation can be made extremely simple.

In particular, the plurality of honeycomb matrices are concurrently fabricated by respectively lap winding a corrugated sheet and a flat sheet around a common core bar, the intermediate tube is formed by winding the wide sheet around the plurality of honeycomb matrices fabricated on the core bar, and the core bar is subsequently pulled out from the honeycomb matrices to form the subassembly. Accordingly, the plurality of honeycomb matrices can be efficiently fabricated into the same size, and the formation of the intermediate tube can be subsequently affected simply.

In addition, by subjecting the outer tube with the subassembly inserted therein to diameter reduction prior to the heat treatment, the degree of contact between adjacent ones of the honeycomb matrices, the intermediate tube, and the outer tube can be promoted, thereby making it possible to ensure more satisfactory bonding or brazing.

Furthermore, by forming the wide sheet by lap winding a flat sheet and a corrugated sheet into a lap-wound layered form, an increase in the strength of the wide sheet can be attained, the possibility of deformation or the like at the time of inserting the subassembly into the outer tube is eliminated, and the insertion is facilitated.

What is claimed is:

1. A metal substrate for carrying a catalyst comprising:

an outer tube;

a plurality of honeycomb matrices arranged in series in the outer tube; and an intermediate tube, which is formed by winding a wide sheet made of a metal foil around an outer peripheral surface of the plurality of honeycomb matrices, wherein the intermediate tube is diffusion bonded to the plurality of honeycomb matrices; and wherein the intermediate tube is brazed in a predetermined region on an outer peripheral surface at an end portion thereof and are bonded to the outer tube.

2. The metal substrate according to claim 1, wherein the wide sheet is formed into a lap-wound layered form in which a flat sheet and a corrugated sheet are lapped and wound.

3. A method for manufacturing a metal substrate for carrying a catalyst, the metal substrate having a plurality of honeycomb matrices arranged in series in an outer tube, the method comprising the steps of:

winding a wide sheet formed of a metal foil around outer peripheral surfaces of the plurality of honeycomb matrices to form a subassembly in which the plurality of honeycomb matrices are arranged in an intermediate tube formed of the wide sheet;

winding a brazing filler material around an outer peripheral surface of the intermediate tube at an end portion of the intermediate tube;

inserting the subassembly into an outer tube;

heat processing the outer tube into which the subassembly is inserted;

lapping and winding each corrugated sheet and each flat sheet around a common core bar to form the plurality of honeycomb matrices concurrently;

winding the wide sheet around the plurality of honeycomb matrices to form the intermediate tube; and pulling out the common core bar from the honeycomb matrices to form the subassembly.

4. The method according to claim 3, wherein the heat processing step bonds the plurality of honeycomb matrices to the intermediate tube and brazes the intermediate tube to the outer tube.

5. The method according to claim 4, further comprising the steps of reducing an outer diameter of the outer tube into which the subassembly is inserted, before the heat processing step.

6. The method according to claim 4, further comprising the steps of lapping and winding a corrugated sheet and a flat sheet in a lap-wound layered manner to form the wide sheet.

7. The method according to claim 3, wherein the step of lapping and winding comprises the step of:

respectively providing a plurality of spacers, one less in number than the plurality of honeycomb matrices, between the plurality of honeycomb matrices, in order to maintain a predetermined spacing between the plurality of honeycomb matrices.

8. The method according to claim 7, wherein each of the plurality of spacers includes a top half-cylinder and a bottom half-cylinder removeably coupled together to form a circular spacer, and wherein the method further comprises the step of:

removing the top half-cylinder of each of the plurality of spacers from the subassembly so as to leave only the bottom half-cylinder of the plurality of spacers provided between the plurality of honeycomb matrices in the subassembly.

9. The method according to claim 8, wherein the top half-cylinder and the bottom half-cylinder of each of the plurality of spacers are coupled to each other by way of first and second magnets respectively provided on the top half-cylinder and the bottom half-cylinder of each of the plurality of spacers.

10. The method according to claim 8, further comprising the step of:

after the step of pulling out the common core bar, inserting first and second core bars, each being less than one-half in length than a length of the common core bar, through end-positioned ones of the plurality of honeycomb matrices, wherein non-end-positioned ones of the plurality of matrices do not have either of the first and second core bars provided therethrough.

11. The method according to claim 10, further comprising the steps of:

after the step of inserting the first and second core bars, removing the bottom half-cylinder of each of the plurality of spacers from the subassembly; and pulling out the first and second core bars from the end-positioned ones of the plurality of honeycomb matrices, to form the subassembly.

* * * * *